US006133889A

United States Patent [19]

Yarsunas et al.

[11] Patent Number: 6,133,889

[45] Date of Patent: Oct. 17, 2000

[54] LOG PERIODIC DIPOLE ANTENNA HAVING AN INTERIOR CENTERFEED MICROSTRIP FEEDLINE

[75] Inventors: George D. Yarsunas, Mount Holly, N.J.; Charles M. Powell, Holland, Pa.

[73] Assignee: Radio Frequency Systems, Inc., Marlboro, N.J.

[21] Appl. No.: 09/005,749

[22] Filed: Jan. 12, 1998

Related U.S. Application Data

[63] Continuation-in-part of application No. 08/807,560, Feb. 28, 1997, abandoned, which is a continuation-in-part of application No. 08/675,486, Jul. 3, 1996, abandoned.

[51] Int. Cl.[7] ..... H01Q 11/10

[52] U.S. Cl. ..... 343/792.5; 343/795; 343/813

[58] Field of Search ..... 343/792.5, 793, 343/794, 795, 813, 700 MS; H01Q 11/10

[56] References Cited

U.S. PATENT DOCUMENTS

| | | | |
|---|---|---|---|
| 3,079,602 | 2/1963 | Hamel et al. | 343/792.5 |
| 3,181,161 | 4/1965 | Minerva | 343/792.5 |
| 3,193,831 | 7/1965 | Yang | 343/792.5 |
| 3,466,655 | 9/1969 | Mayes et al. | 343/792.5 |
| 3,482,250 | 12/1969 | Maner | 343/766 |
| 3,599,217 | 8/1971 | Grant | 343/815 |
| 3,681,769 | 8/1972 | Perrotti et al. | 343/853 |
| 3,747,114 | 7/1973 | Shyhalla | 343/853 |
| 3,750,185 | 7/1973 | Evans | 343/814 |
| 3,887,926 | 6/1975 | Schwartz et al. | 343/816 |
| 4,287,518 | 9/1981 | Ellis, Jr. | 343/700 MS |
| 4,785,307 | 11/1988 | Kuo | 343/792.5 |
| 4,825,220 | 4/1989 | Edward et al. | 343/795 |
| 4,843,403 | 6/1989 | Lalezari et al. | 343/767 |
| 4,907,011 | 3/1990 | Kuo | 343/792.5 |
| 5,111,211 | 5/1992 | Dahlberg | 343/700 MS |
| 5,274,391 | 12/1993 | Connolly | 343/820 |
| 5,293,176 | 3/1994 | Elliot | 343/797 |
| 5,321,414 | 6/1994 | Alden et al. | 343/816 |
| 5,400,042 | 3/1995 | Tulintseff | 343/727 |
| 5,416,490 | 5/1995 | Popovic | 343/700 MS |
| 5,469,181 | 11/1995 | Yarsunas | 343/815 |
| 5,532,708 | 7/1996 | Krenz et al. | 343/795 |
| 5,629,713 | 5/1997 | Mailandt et al. | 343/808 |
| 5,666,126 | 9/1997 | Lange | 343/781 R |
| 5,898,410 | 4/1999 | DeMarre | 343/792.5 |

FOREIGN PATENT DOCUMENTS

| | | | |
|---|---|---|---|
| 3338444 | 5/1985 | European Pat. Off. | H01Q 11/02 |
| 1286590 | 1/1962 | Germany . | |
| 48008 | 8/1980 | Germany . | |
| 953805 | 4/1964 | United Kingdom . | |

OTHER PUBLICATIONS

"Figures 14–30 (circa 1958), 14–31 and 14–32" by Richard C. Johnson, *Antenna Engineering Handbook,* Third Edition, Copyright 1993, 1984, 1961 by McGraw–Hill, Inc.

"*Patent Abstracts of Japan*", vol. 015, No. 004 (E–1020), Jan. 8, 1991, and JP 02 260803 A by Kohei et al., "Log Periodic Dipole Antenna", Oct. 23, 1990, (Japan Radio Co. Ltd.).

*Primary Examiner*—Don Wong
*Assistant Examiner*—Shih-Chao Chen
*Attorney, Agent, or Firm*—Ware, Fressola, Van Der Sluys & Adolphson LLP

[57] ABSTRACT

The invention provides a log periodic dipole antenna having a microstrip center feedline and a log periodic hourglass dipole assembly. The microstrip center feedline means responds to an input radio signal for providing a microstrip center feed radio signal. The log periodic hourglass dipole assembly responds to the microstrip feed radio signal, for providing a log periodic hourglass dipole antenna radio signal.

31 Claims, 18 Drawing Sheets

| FREQ | MHz | VSWR |
|---|---|---|
| 824.000 | 000 | 1.2633 |
| 826.800 | 000 | 1.2891 |
| 829.600 | 000 | 1.2866 |
| 832.400 | 000 | 1.2941 |
| 835.200 | 000 | 1.311 |
| 838.000 | 000 | 1.3295 |
| 840.800 | 000 | 1.3469 |
| 843.600 | 000 | 1.3516 |
| 846.400 | 000 | 1.35 |
| 849.200 | 000 | 1.35 |
| 852.000 | 000 | 1.3511 |
| 854.800 | 000 | 1.3478 |
| 857.600 | 000 | 1.343 |
| 860.400 | 000 | 1.3347 |
| 863.200 | 000 | 1.3359 |
| 866.000 | 000 | 1.3299 |
| 868.800 | 000 | 1.322 |
| 871.600 | 000 | 1.3015 |
| 874.400 | 000 | 1.2795 |
| 877.200 | 000 | 1.2761 |
| 880.000 | 000 | 1.2346 |
| 882.800 | 000 | 1.1536 |
| 885.600 | 000 | 1.0891 |
| 888.400 | 000 | 1.0628 |
| 891.200 | 000 | 1.0381 |
| 894.000 | 000 | 1.0159 |

LOG PERIODIC DIPOLE ANTENNA HAVING AN INTERIOR CENTERFEED MICROSTRIP FEEDLINE

This application is a CIP of Ser. No. 08/807,560 filed Feb. 28, 1997, now abn., which is a CIP of application 08/675,486 filed Jul. 3, 1996 now abn.

BACKGROUND OF THE INVENTION

1. Field of the Invention

The present invention relates generally to antennas, and more particularly, to a log periodic dipole antenna having a microstrip feedline.

2. Description of the Prior Art

Although numerous varieties of log periodic antennas have been in widespread use for years, the log periodic dipole array is often favored because of its ability to operate over a broad frequency range. Because of its unique geometric arrangement, different elements in the array are active at different frequencies. As a result, the log periodic dipole antenna exhibits relatively constant operating characteristics, including gain, feed-point impedance and front-to-back ratio, over the frequency range supported by the log periodic dipole antenna.

The typical log periodic dipole antenna includes several dipole elements of varying lengths which are positioned and spaced according to length. The shortest elements are located at the feed end, or "front end", of the array, with each successive element being of equal or longer length. Also, the electrical connections of opposed elements are alternated to provide a phase shift of 180 degrees between elements.

Log periodic dipole antennas are almost universally fed by a balans feeder connected directly to the shortest elements at the front end of the array. A variety of feedlines are used including coaxial cables and external strip lines. However, these types of feeding arrangements have their shortcomings. First, antenna performance is derated by reduced impedance matching, power handling capacity and pattern interference. Moreover, these arrangements are cumbersome and make the feedline more susceptible to damage from weather elements such as wind and ice, especially when the antenna is mounted on a tall tower.

Consequently, an alternative arrangement for feeding a log periodic dipole antenna is highly desirable.

SUMMARY OF THE INVENTION

The present invention is designed to overcome the limitations inherent in the various feed arrangements for log periodic dipole antennas discussed above and toward this end it includes a novel log periodic dipole antenna having a microstrip feedline.

The log periodic dipole antenna of the present invention includes at least one log periodic dipole assembly having two dipole strips with a dipole strip connector therebetween and a microstrip feedline having a centerfeed conductor coupled to the dipole strip connector.

The log periodic dipole antenna of the present invention exhibits superior impedance matching between the dipoles and the input connector, a high front-to-back ratio and excellent directional characteristics, especially in the cellular frequency band (824–894 MHz). Moreover, the microstrip feedline makes the antenna less cumbersome and more rugged than front end feed versions.

The invention also provides a log periodic dipole antenna having a transmission system and a log periodic hourglass dipole assembly. The transmission system responds to an input signal for providing a transmission system signal. The log periodic hourglass dipole assembly responds to the transmission system signal, for providing a log periodic hourglass dipole antenna signal. The input signal is typically a radio signal having a Personal Communication Systems (PCS) frequency in a frequency range of 1.850–1.990 Gigahertz.

In one embodiment, the transmission system is a microstrip feedline having a centerfeed conductor, and the at least one log periodic hourglass dipole assembly has two hourglass dipole strips and a dipole strip connector coupled to the centerfeed conductor of the microstrip feedline.

In another embodiment, the transmission system is a microstrip feedline having a top fed conductor.

In still another embodiment, the transmission system is a cabling system instead of the microstrip feedline. The scope of the invention is not intended to be limited to any particular type of transmission system.

The log periodic dipole antenna of the present invention provides a high front-to-back ratio with a ninety degree beamwidth at PCS frequencies. Also at cellular frequencies, one hundred degree beamwidths with a high front-to-back ratio are possible since cellular antennas do not suffer from radome shrinkage.

Other advantages will become apparent to those skilled in the art from the following detailed description read in conjunction with the appended claims and drawings attached hereto.

BRIEF DESCRIPTION OF THE DRAWING

The drawing, not drawn to scale, includes.

BEST MODE FOR CARRYING OUT THE INVENTION

Figure 1:
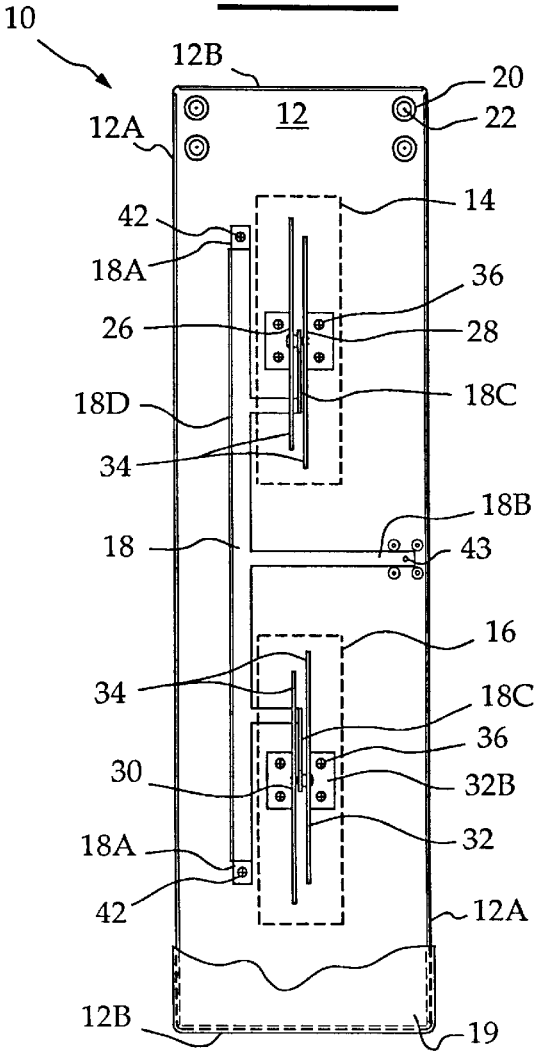
FIG. 1 is a front plan view of a log periodic dipole antenna embodying the principles of the present invention.
Figure 2:
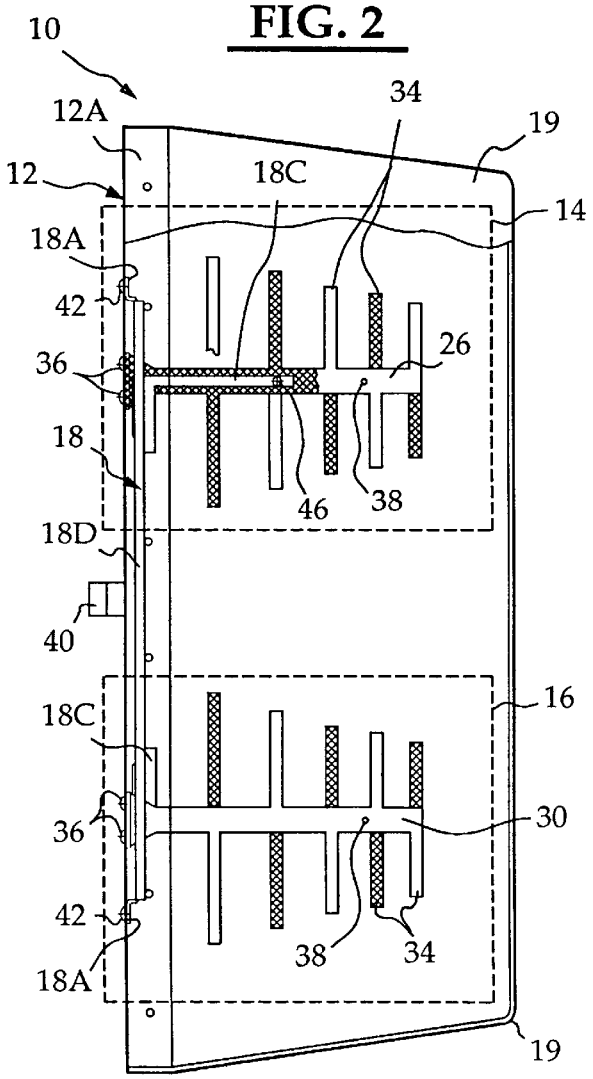
FIG. 2 is a left side cutaway view of the log periodic dipole antenna illustrated in FIG. 1.
Figure 3:
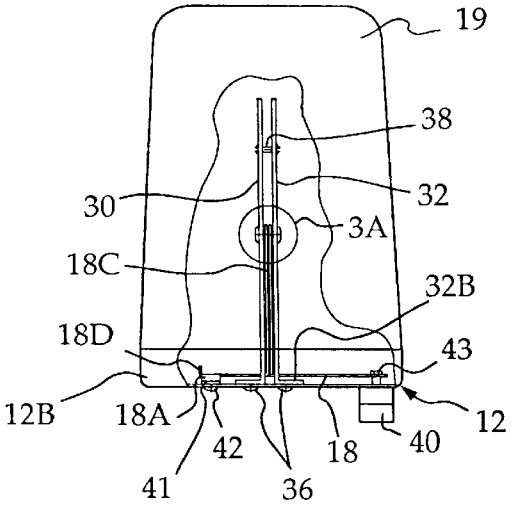
FIG. 3 is a bottom cut-away view of the log periodic dipole antenna illustrated in FIG. 1.

FIGS. 1–3 illustrate a center fed log periodic dipole antenna of the present invention, generally indicated by reference numeral 10. The antenna 10 includes a reflector 12, an upper dipole assembly 14, a lower dipole assembly 16 and a microstrip feedline 18.

The reflector 12 is typically mounted vertically to an antenna tower (not illustrated) and supports the various components described above while shaping and directing the radiation pattern of the antenna 10. The reflector 12 is generally rectangular in shape and includes perforated sides 12A and ends 12B to which a radome 19 is attached. Apertures 20 (FIG. 1) and mounting bolts 22 (FIG. 1) are provided for mounting the antenna 10 to a fixture or tower (not illustrated). The reflector 12 may be made from a variety of materials, such as aluminum, and may have a variety of shapes depending upon the particular antenna application.

The upper dipole assembly 14 includes an upper left dipole strip 26 and an upper right dipole strip 28, mounted perpendicular to reflector 12 and adjacent and parallel to each other. The lower dipole assembly 16 includes a lower left dipole strip 30 and a lower right dipole strip 32, mounted perpendicular to reflector 12 and adjacent and parallel to each other directly below the upper dipole assembly 14.

The dipole strips 26, 28, 30, 32 are generally rectangular in shape and may be made from a variety of conductive materials such as aluminum sheeting or other suitable conductive material, depending upon a particular antenna application. Each dipole strip 26, 28, 30, 32 includes a number of integrally formed radiating elements 34 which, as is typical for log periodic dipole antennas, are of varying size and spacing, so that the antenna 10 has different active regions over a particular frequency range.

Figure 4:
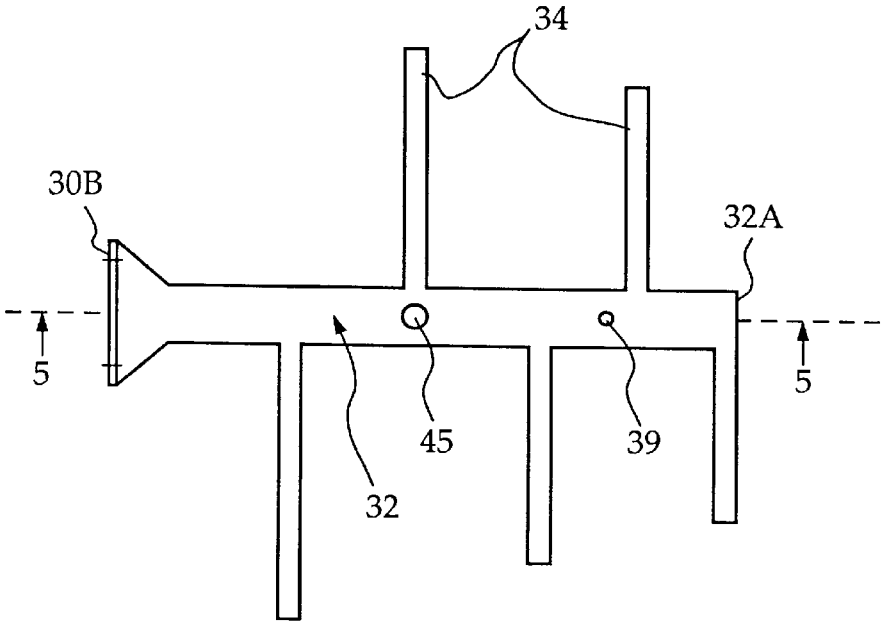
FIG. 4 is a plan view of one of the dipole strips with attached radiating elements illustrated in FIG. 2.
Figure 5:
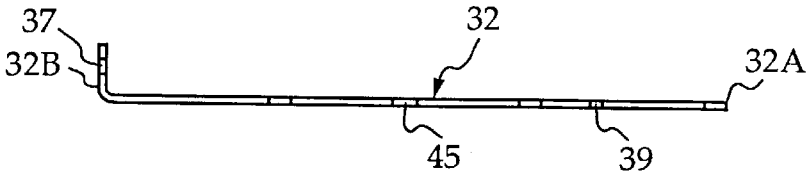
FIG. 5 is a bottom view of the dipole strip with radiating elements illustrated in FIG. 4 along lines 5–5'.

As illustrated in FIG. 4, the radiating elements 34 are generally rectangular in shape and extend perpendicularly from the lower right dipole strip 32, with the shortest of the radiating elements 34 being located at a front end 32A and the longest of the radiating elements 34 being located near a "L" shaped base 32B of the lower right dipole strip 32. As illustrated in FIG. 5 the "L" shaped base 32B provides for the mounting of the lower right dipole strip 32 to the reflector 12 with dipole strip mounting screws 36 (FIGS. 1–3), secured through dipole mounting apertures 37 (FIG. 5).

Each of the other dipole strips 26, 28, 30 are identical in size and shape to the lower left dipole strip 32. However, the upper right dipole strip 28 and the lower left dipole strip 30 do not include dipole strip apertures 45. As best illustrated in FIG. 3, the lower left and right dipole strips 30, 32 are mounted back to back on reflector 12 and held apart by a nonconducting spacer 38 mounted through nonconducting spacer apertures 39 (FIGS. 4,5) to form a dipole having successive elements which are 180° out of phase with each other so that the antenna 10 provides log periodic dipole antenna signals. The upper left and right dipole strips 26, 28 are mounted to the reflector 12 in a similar fashion.

As best illustrated in FIGS. 1, 2 and 6–8, the microstrip feedline 18 is an electrical conductor which is mounted directly to the reflector 12 and receives input signals from an input connector 40 and provides microstrip center feed signals to the upper and lower dipole assemblies 14, 16. The microstrip feedline 18 is a generally "T" shaped single piece of thin aluminum sheet which is sized and dimensioned to achieve the best impedance match between the antenna and an input connector 40. The shape and size of the microstrip feedline 18 may vary depending upon the specific antenna application. In addition, although illustrated as a single piece in the present invention, the microstrip feedline 18 may also be fabricated in separate pieces and joined together. The microstrip feedline 18 of the present invention includes mounting portions 18A, an input feed portion 18B, center-feed conductors 18C and a rim portion 18D.

Figure 6:
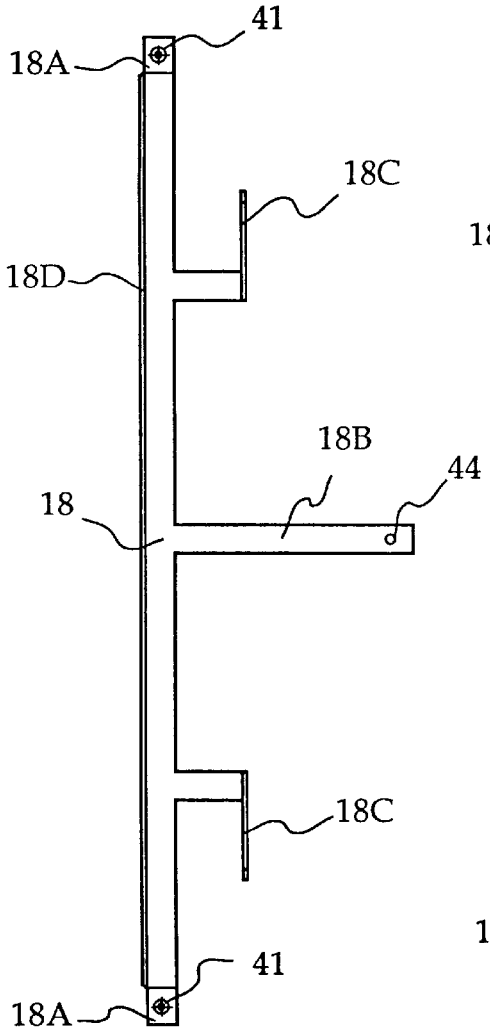
FIG. 6 is an enlarged front plan view illustration of the microstrip feedline of the log periodic dipole antenna illustrated in FIG. 1.
Figure 7:
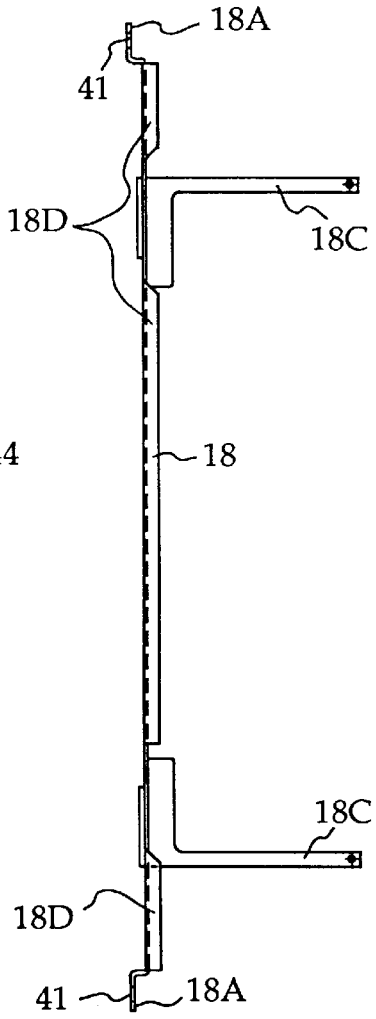
FIG. 7 is a side plan view of the microstrip feedline illustrated in FIG. 6.
Figure 8:
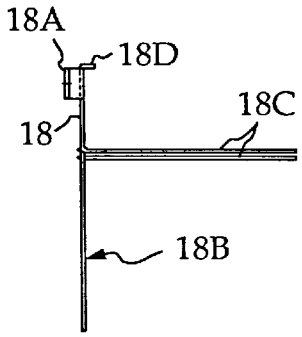
FIG. 8 is a bottom plan view of the microstrip feedline illustrated in FIG. 7.

As best illustrated in FIGS. 6 and 7, the mounting portions 18A consist of bent sections located at the top and bottom ends of the microstrip feedline 18 and include microstrip mounting apertures 41 (FIGS. 6,7) for securing the microstrip feedline 18 to the reflector 12 with microstrip fasteners 42 (FIGS. 1–3).

The input feed portion 18B is the "stem" of the "T" and is mounted to the reflector 12 with a feed fastener 43 (FIGS.

1,3) through a feed fastener aperture 44 (FIG. 6) which also provides an electrical connection between the microstrip feedline 18 and the input connector 40.

Figure 3A:
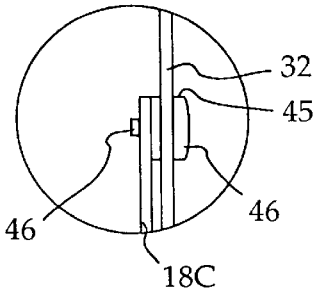
FIG. 3A is an example illustration of a segment of the log periodic dipole antenna illustrated in FIG. 3.

As best illustrated by the cutaway view of the upper dipole assembly 14 in FIG. 2 and the lower dipole assembly 16 of FIG. 3, the centerfeed conductors 18C are generally "L" shaped portions which are oriented perpendicular to the reflector 12 and parallel to the microstrip feedline 18. The centerfeed conductors 18C are sandwiched between the left and right dipole strips 26, 28, and 30, 32 of the upper and lower dipole assemblies 14, 16 to minimize their effect on antenna performance and to protect them from weather elements, making the antenna 10 more robust. However, the centerfeed conductors 18C are electrically connected to only one of the dipole strips 26, 28, 30, 32 in each dipole assembly 14, 16. Specifically, one of the centerfeed conductors 18C is electrically connected to the upper left dipole strip 26 on the upper dipole assembly 14 while another centerfeed conductor 18C is electrically connected to the lower right dipole strip 32 of the lower dipole assembly 16. This is accomplished with dipole strip connectors 46 secured through dipole strip apertures 45 (FIGS. 4, 5) near a fourth of the radiating elements 34. FIG. 3A illustrates how one of the centerfeed conductors 18C is connected to the lower right dipole strip 32 with the dipole strip connector 46. The other centerfeed conductor 18C is connected to the upper left dipole strip 26 in a similar fashion. The dipole strip connectors 46 may be made from a variety of materials, such as aluminum.

As would be appreciated by a person skilled in the art, the arrangement of the electrical connections between the centerfeed conductors 18C and the dipole assemblies 14, 16 may vary depending upon the number and position of dipole assemblies used without departing from the scope of the present invention. As best illustrated in FIG. 2, the centerfeed conductors 18C are connected to each of the dipole strips 26, 32 at approximately the midpoint at the fourth of the radiating elements 34. In the specific configuration of the present invention, superior performance was achieved by connecting the centerfeed conductors 18C at these locations. However, alternative configurations may be used depending upon the particular antenna application without departing from the scope of the present invention, so long as the centerfeed conductors 18C are arranged between the left and right dipole strips 26, 28, 30, 32.

As illustrated in FIGS. 6 and 7, one side of the microstrip feedline 18 is bent for form a rim portion 18D along one edge of the microstrip feedline 18 to provide structural rigidity.

In one particular embodiment of the present invention, the reflector 12 is made from 0.060" aluminum sheeting and has a length of 24", a width of 6" and a side wall height of 1". Each of the dipole strips 26, 28, 30, 32 are also made from 0.060" aluminum sheeting and are 6.865" in height, have five radiating elements 34, each 0.25" in width and varying in length from 2.173" to 3.3" as measured from the center point of the dipole. The microstrip feedline 18 is 0.060" thick, 0.460" wide and 15.777" long.

Figure 9:
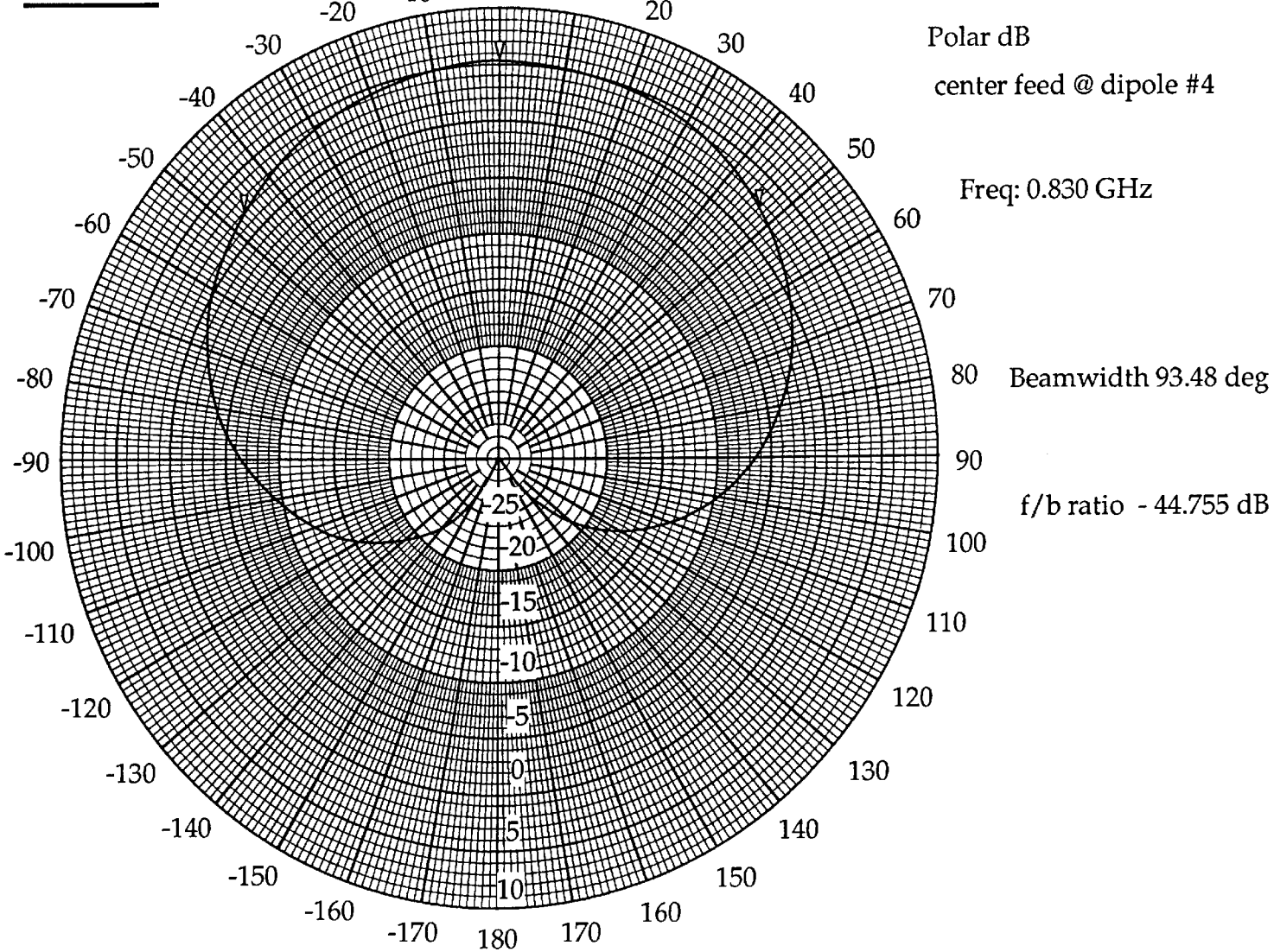
FIG. 9 illustrates the azimuth pattern for the log periodic dipole antenna of FIG. 1 at an operational frequency of 0.830 GHz having a beamwidth of 93.48 degrees and a front to back ratio of −44.755 dB.
Figure 10:
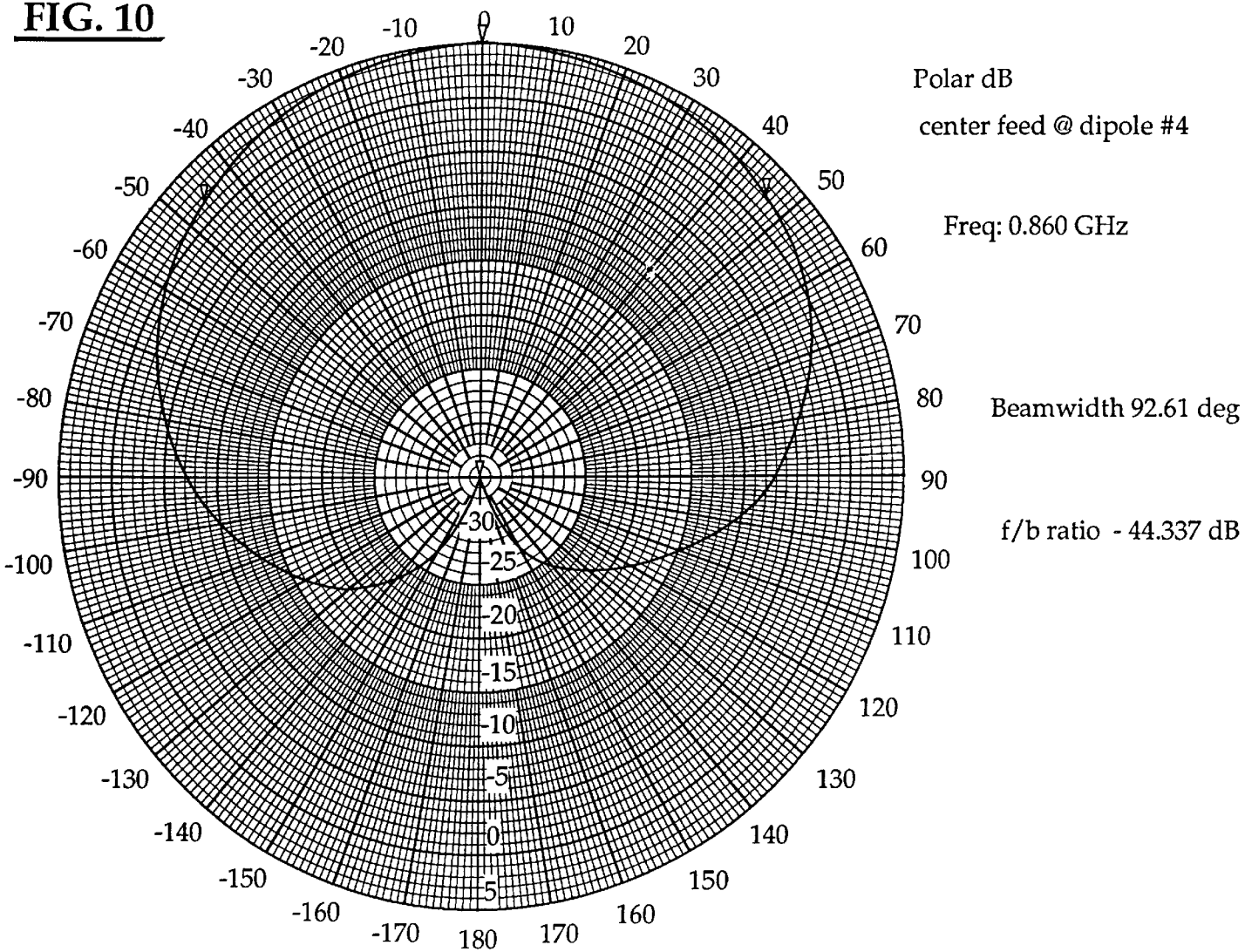
FIG. 10 illustrates the azimuth pattern for the log periodic dipole antenna of FIG. 1 at an operational frequency of 0.860 GHz having a beamwidth of 92.61 degrees and a front to back ratio of −44.337 dB.
Figure 11:
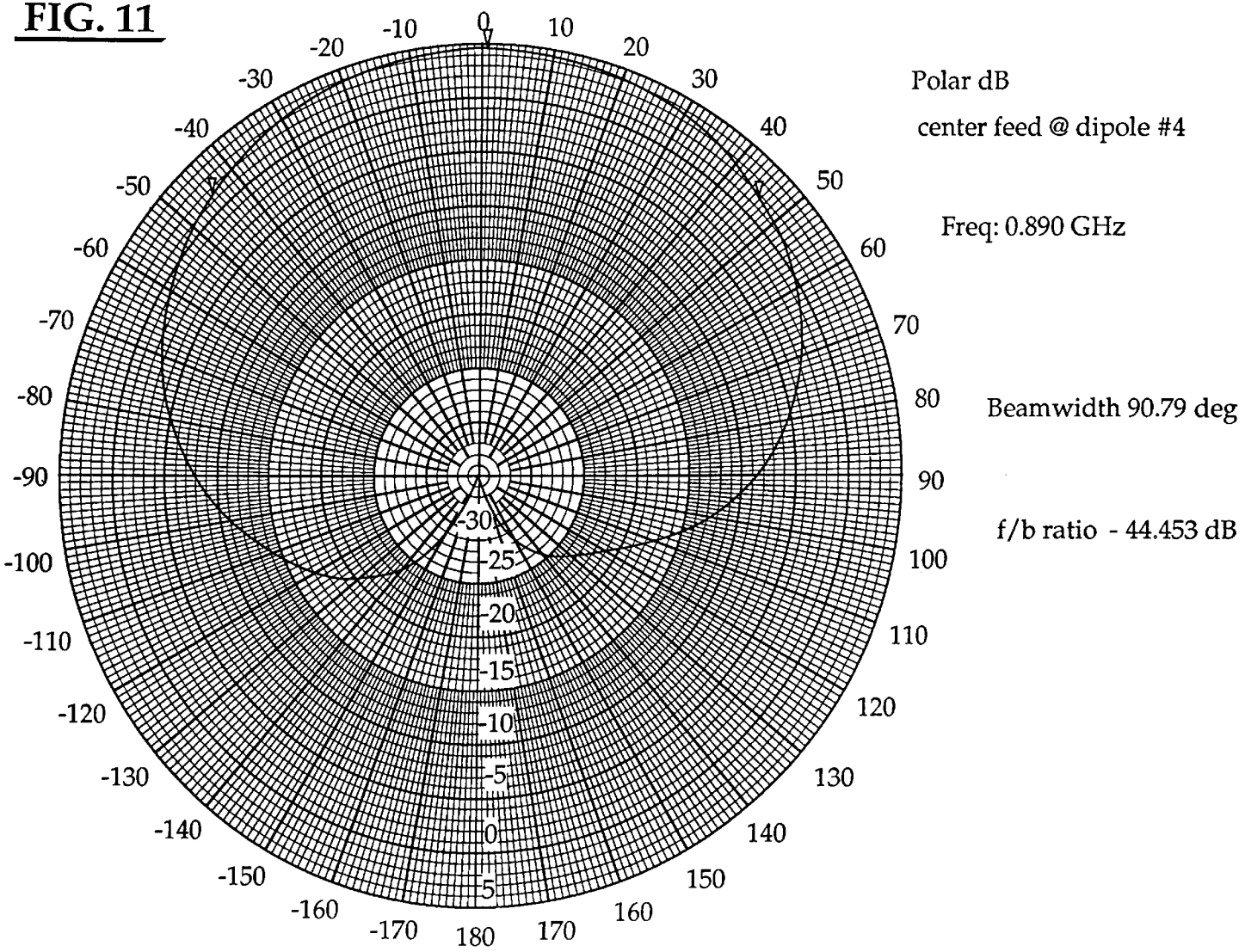
FIG. 11 illustrates the azimuth pattern for the log periodic dipole antenna of FIG. 1 at an operational frequency of 0.890 GHz having a beamwidth of 90.79 degrees and a front to back ratio of −44.453 dB.
Figure 12:
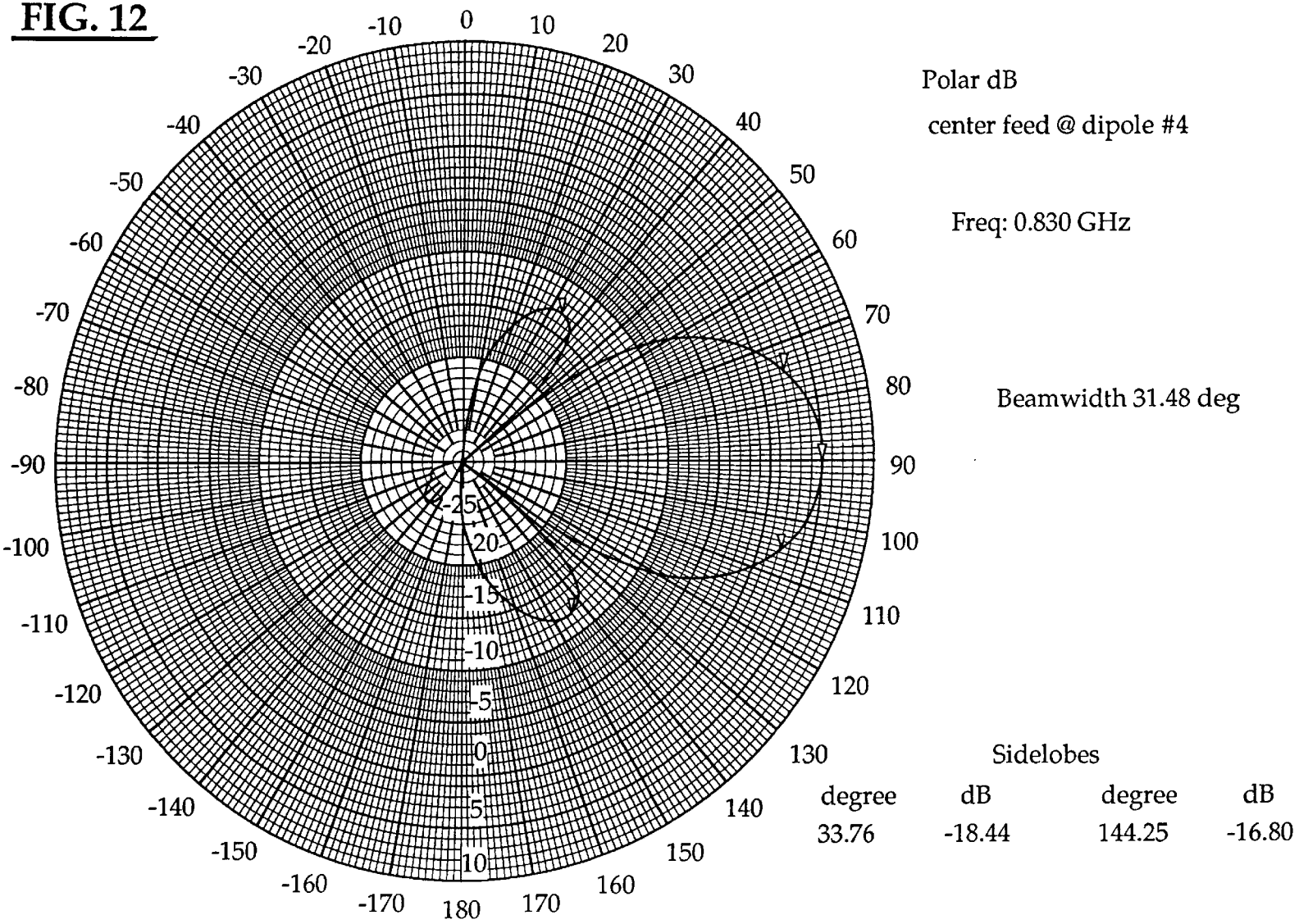
FIG. 12 illustrates the elevation pattern for the log periodic dipole antenna of FIG. 1 at an operational frequency of 0.830 GHz having a beamwidth of 31.48 degrees.
Figure 13:
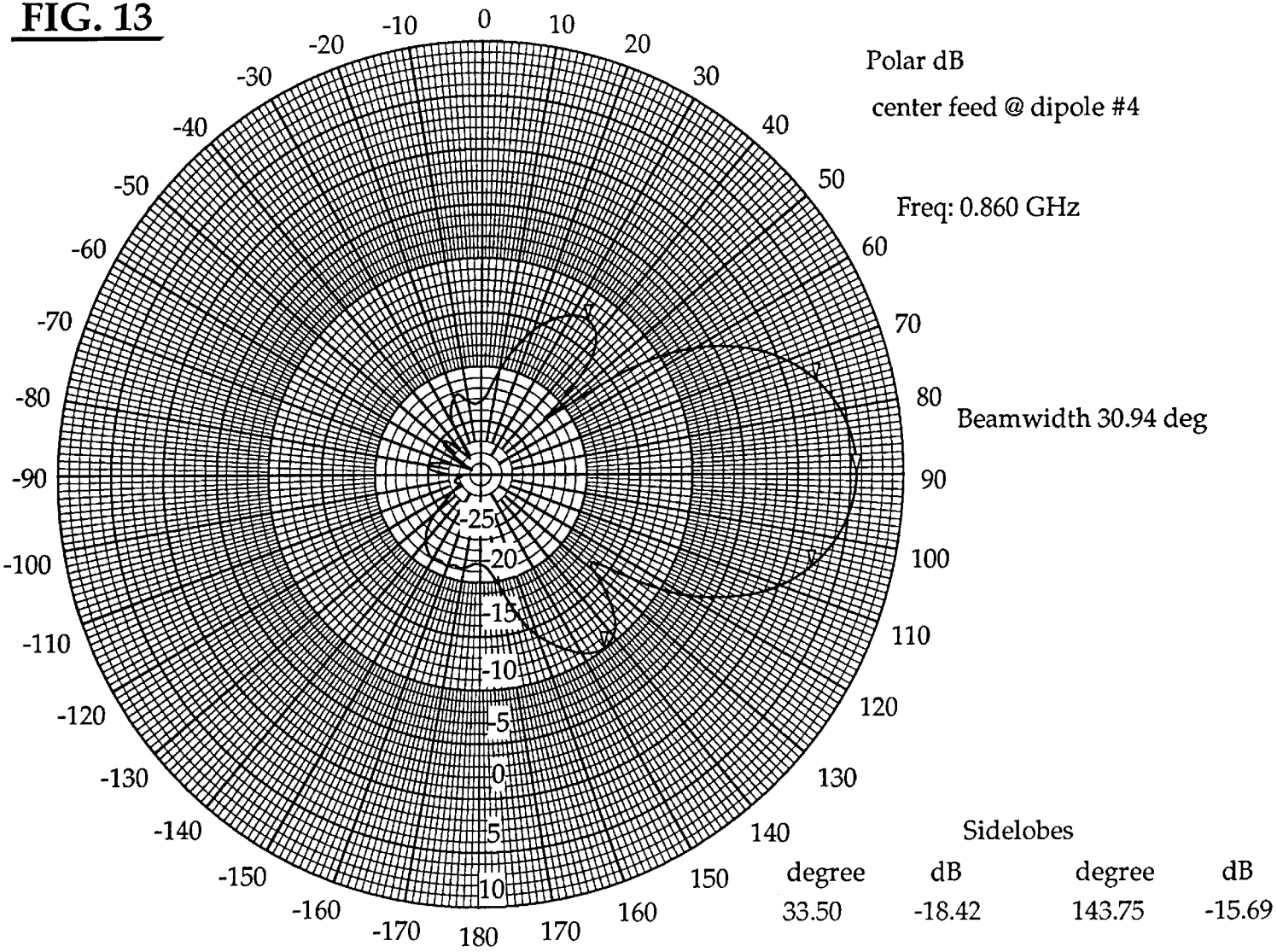
FIG. 13 illustrates the elevation pattern for the log periodic dipole antenna of FIG. 1 at an operational frequency of 0.860 GHz having a beamwidth of 30.94 degrees.
Figure 14:
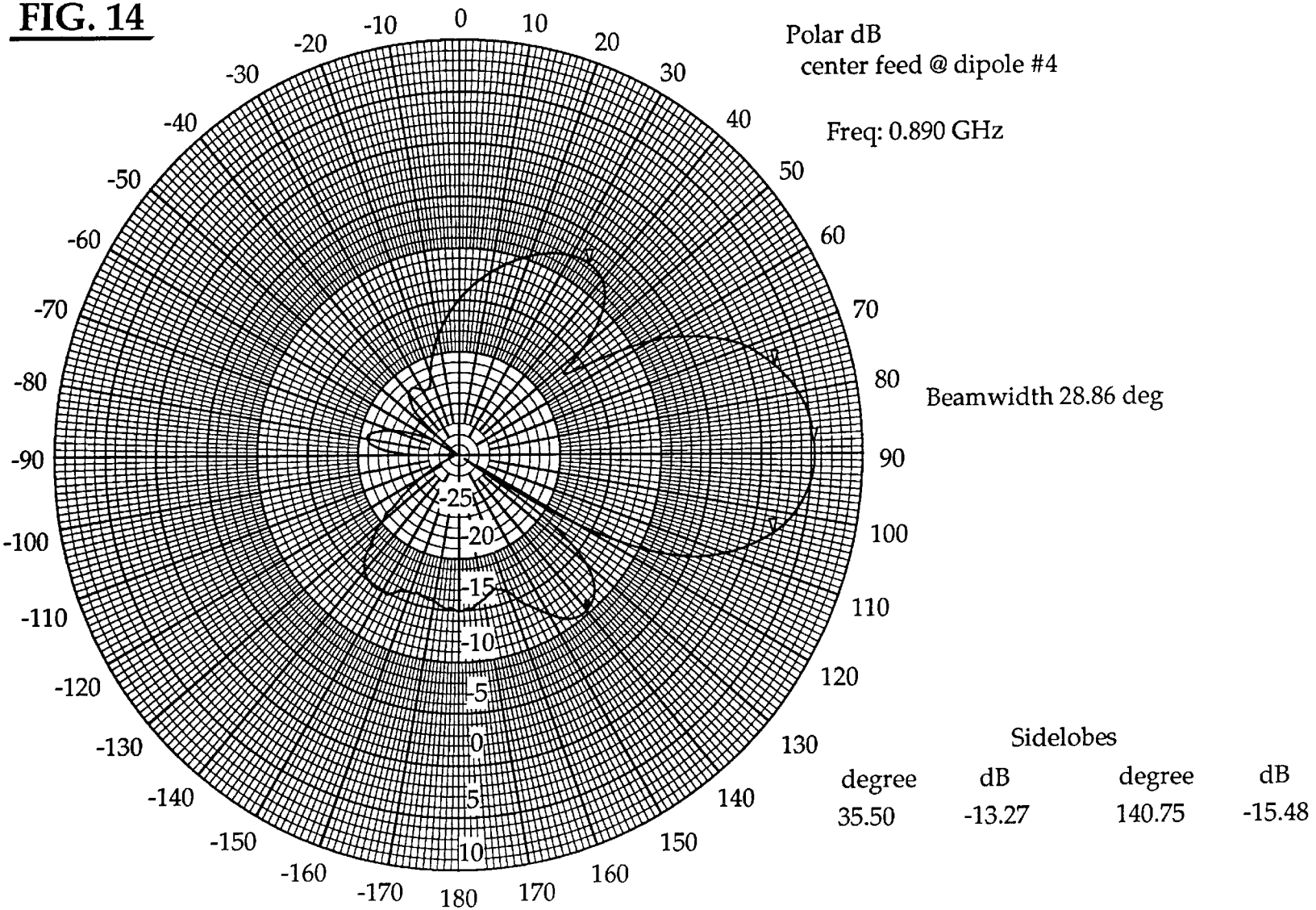
FIG. 14 illustrates the elevation pattern for the log periodic dipole antenna of FIG. 1 at an operational frequency of 0.890 GHz having a beamwidth of 28.86 degrees.
Figure 15:
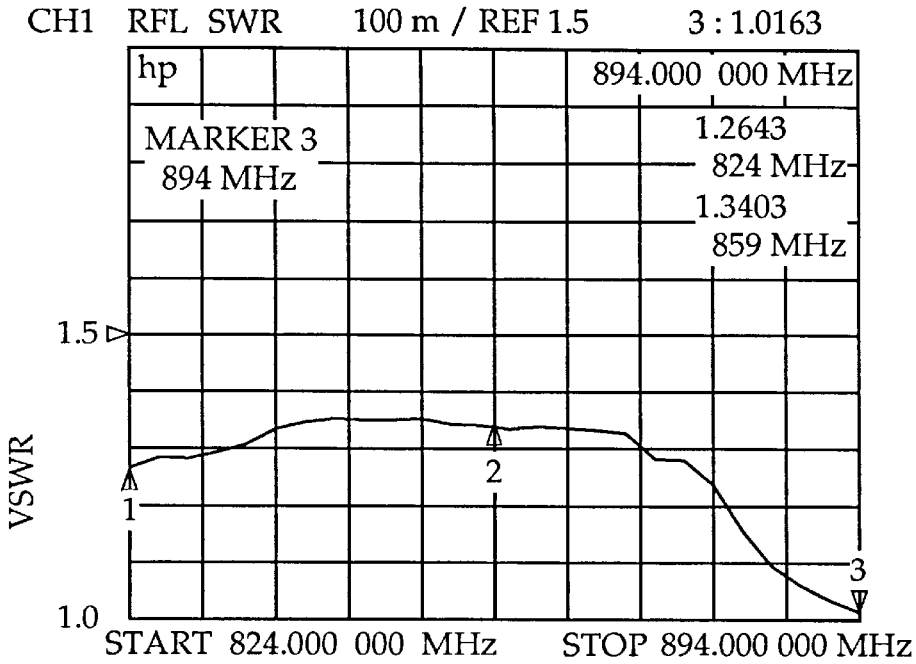
FIG. 15 which illustrates the standing wave ratio (SWR) of the log periodic dipole antenna of FIG. 1 between the frequencies of 824 MHz and 894 MHz and having a VSWR (voltage standing wave ratio) of between 1.5 and 1.0.

FIGS. 9–11 illustrate the response pattern of this particular log periodic dipole antenna at the operational frequencies of 0.830, 0.860 and 0.890 GHz having beamwidths and front-to-back ratios of 93.48 degrees, −44.755 dB, 92.61 degrees, 44.337 DB and 90.79 degrees, −44.453 dB respectively. FIGS. 12–14 illustrate the elevation pattern for this antenna at these same operational frequencies at beamwidths of 31.48, 30.54 and 28.86 degrees. FIG. 15 illustrates the voltage standing wave ratio (VSWR) of the antenna over the cellular frequency band of 824–894 MHz. The measured performance indicates that the antenna has a VSWR of between 1.5 and 1 which, as would be appreciated by a person skilled in the art, is well within the accepted industry standard for satisfactory impedance performance.

The center fed log periodic dipole antenna of the present invention is illustrated as having two dipole assemblies 14, 16, as would be appreciated by a person skilled in the art, any number of dipole assemblies, including only one, could be provided without departing from the scope of the present invention. In addition, as would be appreciated by a person skilled in the art, the dimensions of the various components of the present invention may be sized differently depending upon the specific application. Most importantly, a person skilled in the art would readily recognize how the unique arrangement of the center fed log periodic dipole antenna of the present invention overcomes the disadvantages of prior front end feed arrangements.

The aforementioned log periodic dipole antenna has some shortcomings in that it has a narrow horizontal beamwidth. Only the narrowest of reflectors can be used to achieve a ninety degree beamwidth at Personal Communication Systems (PCS) frequencies, which are typically in a frequency range of 1.850–1.990 Gigahertz. Ninety degrees is the desired beamwidth of most North American customers.

The progressively shorter radiating elements of the log periodic dipole antenna shown and described in the aforementioned antenna causes the beamwidth of the antenna to be so narrow. Each time the beam hits the next shorter arm, it shrinks a little. The number of arms can not be reduced, because they are what creates the high front-to-back ratio.

Hour Glass Dipole Embodiment

Figure 16:
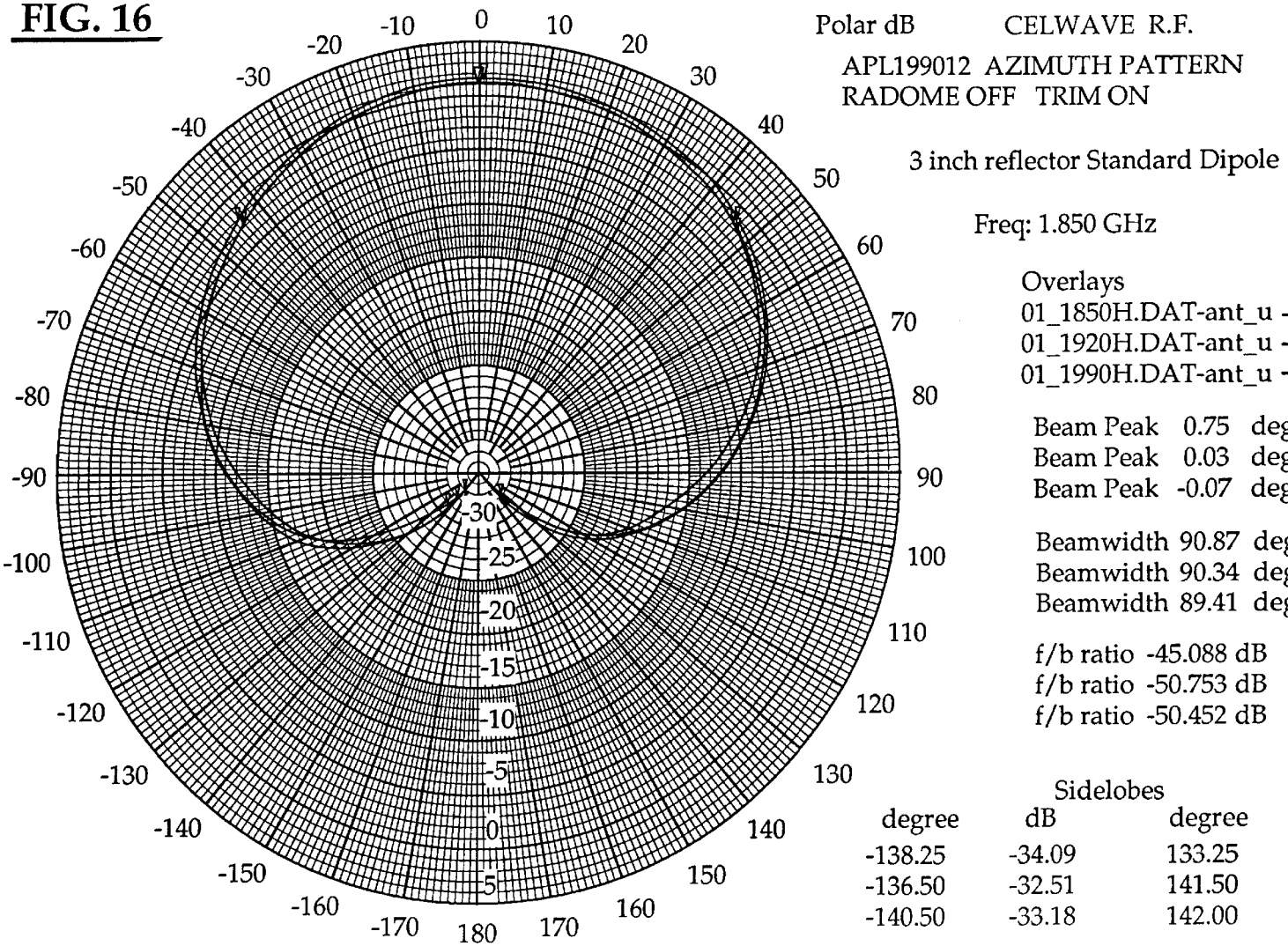
FIG. 16 is a pattern for the aforementioned antenna using the typical dipole with a three inch reflector and with the radome off at an operational frequency of 1.850, 1.920 and 1.990 Gigahertz.
Figure 17:
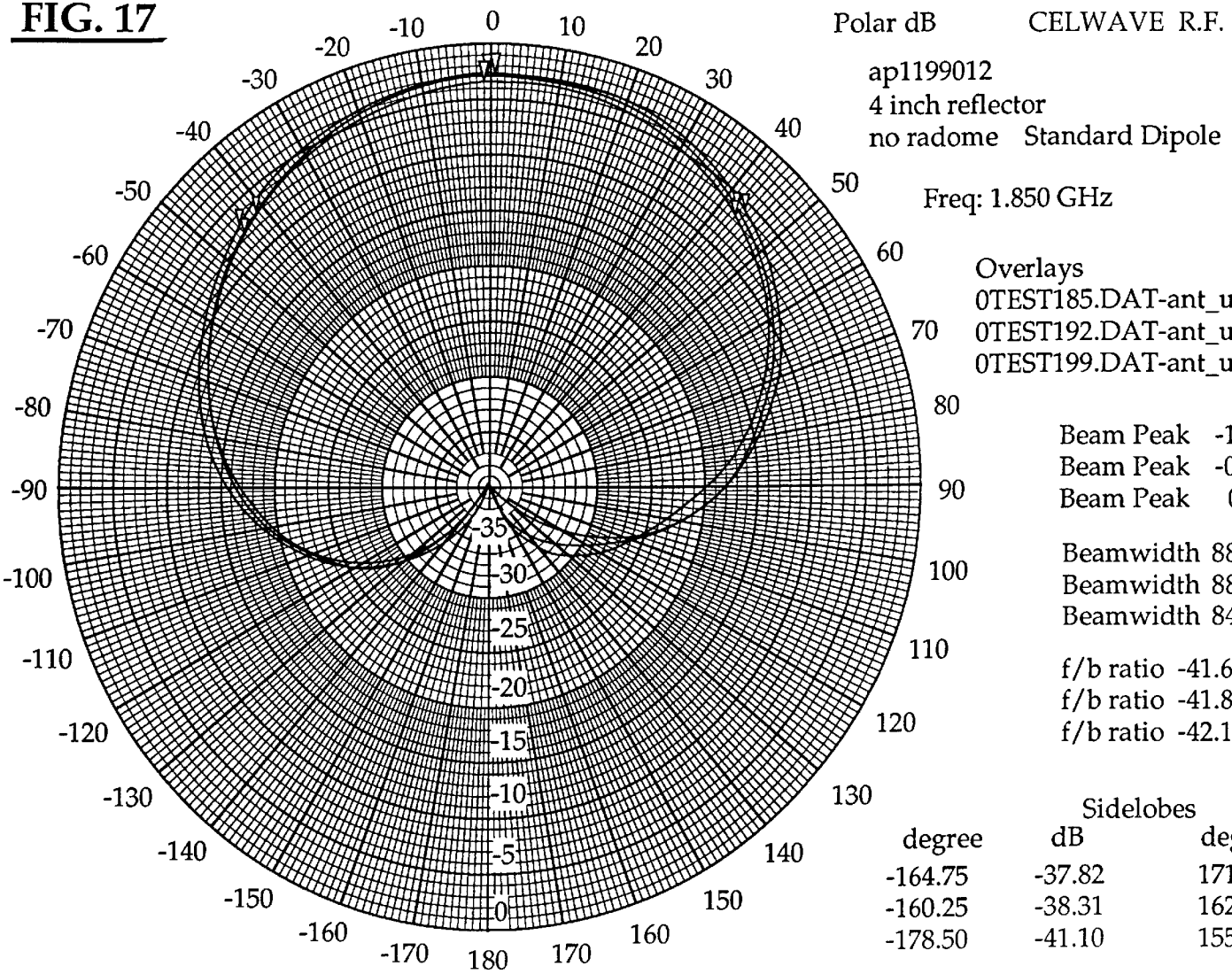
FIG. 17 is a pattern for the aforementioned antenna using the typical dipole with a four inch reflector and with the radome off at an operational frequency of 1.850, 1.920 and 1.990 Gigahertz.

FIGS. 16 and 17 show patterns measured for the log periodic dipole antenna of the aforementioned antenna using the typical dipole strip and a three and four inch reflector respectively. As shown, ninety degrees is possible with a three inch reflector. This narrow size does not give the antenna engineer sufficient room to feed the antenna with air striplines. Thus, any three inch wide antenna would need to be fed with cables. However, the use of cables is not desirable because they are inherently lossy and have higher intermodulation (noise).

Figure 18:
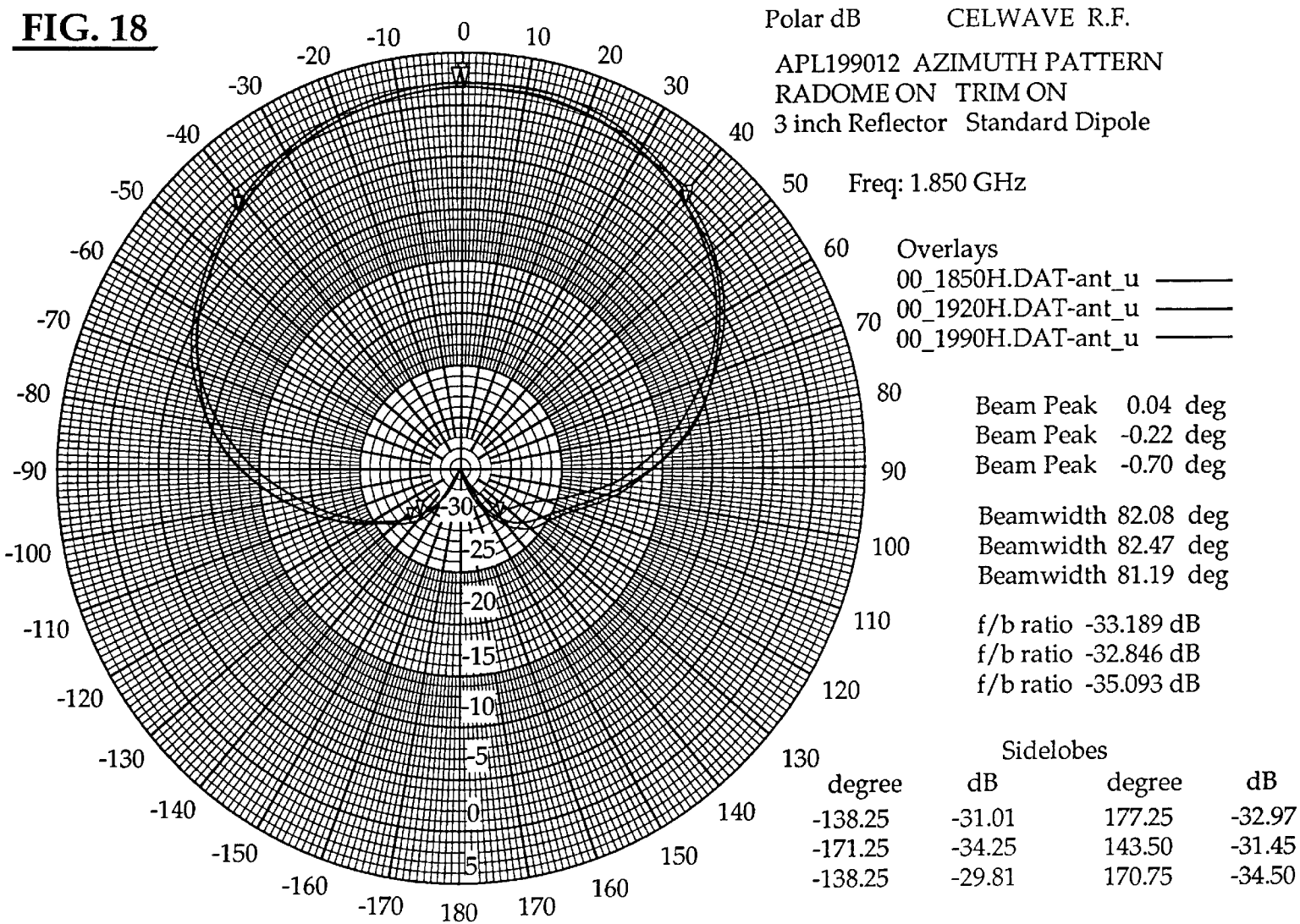
FIG. 18 is a pattern for the aforementioned antenna using the typical dipole with a three inch reflector and with the radome on at an operational frequency of 1.850, 1.920 and 1.990 Gigahertz.
Figure 19:
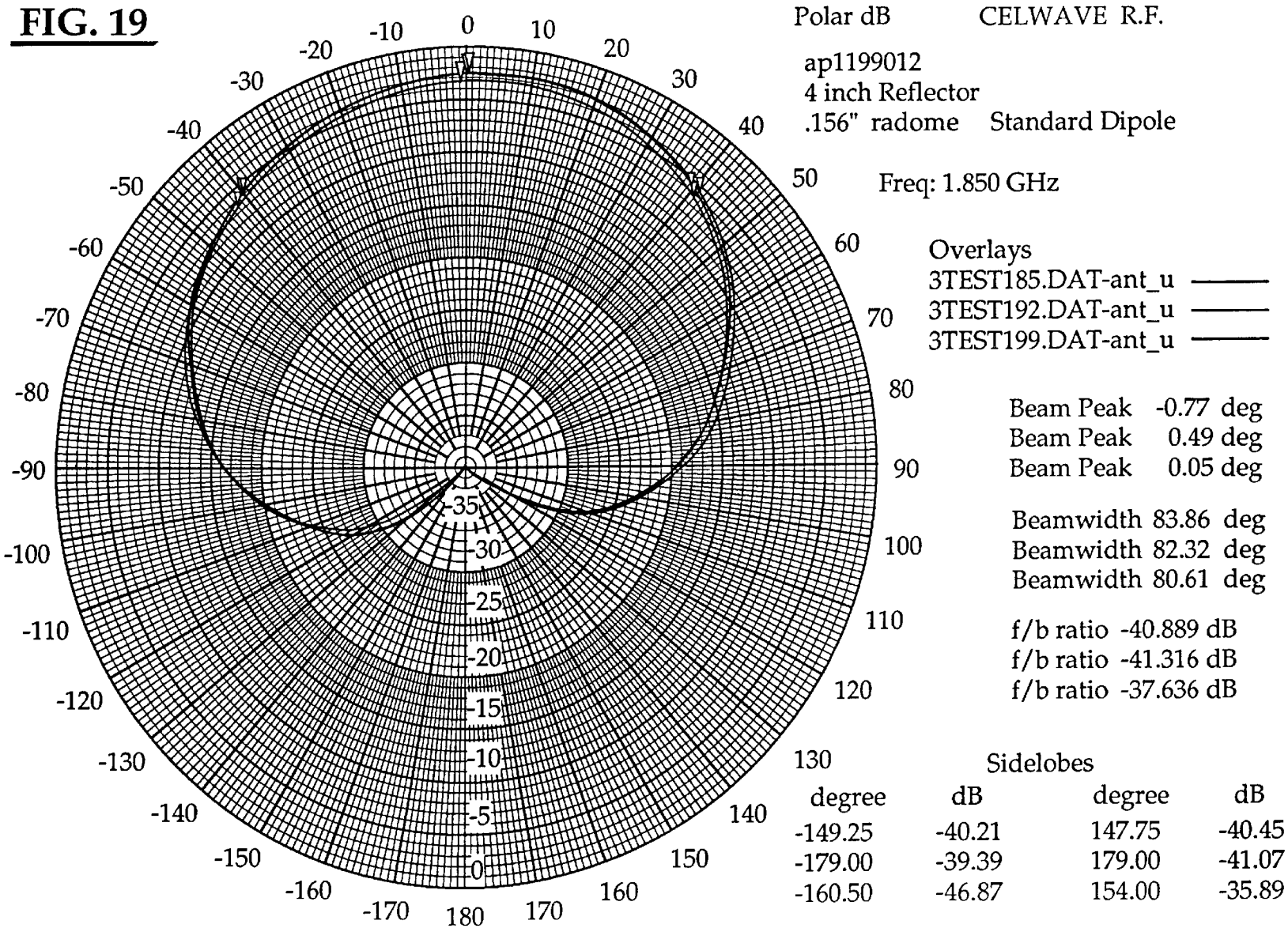
FIG. 19 is a pattern for the aforementioned antenna using the typical dipole with a four inch reflector and with the radome on at an operational frequency of 1.850, 1.920 and 1.990 Gigahertz.

FIGS. 18 and 19 show patterns measured for the log periodic dipole antenna of the aforementioned antenna using the typical dipole strip with a radome placed on the antenna. As shown therein, the beamwidth shrinks to eighty degrees, no matter what size reflector is used. This radome shrinkage at PCS frequencies means that to get the desired ninety degree beamwidth with the radome on, the beamwidth would have to be one hundred degrees with the radome off. However, such a beamwidth is not possible with the log periodic dipole antenna of the aforementioned antenna using the typical dipole.

FIGS. 20–23 show a log periodic dipole antenna generally indicated by reference numeral 100 having an hourglass dipole assembly of the present invention.

Figure 20:
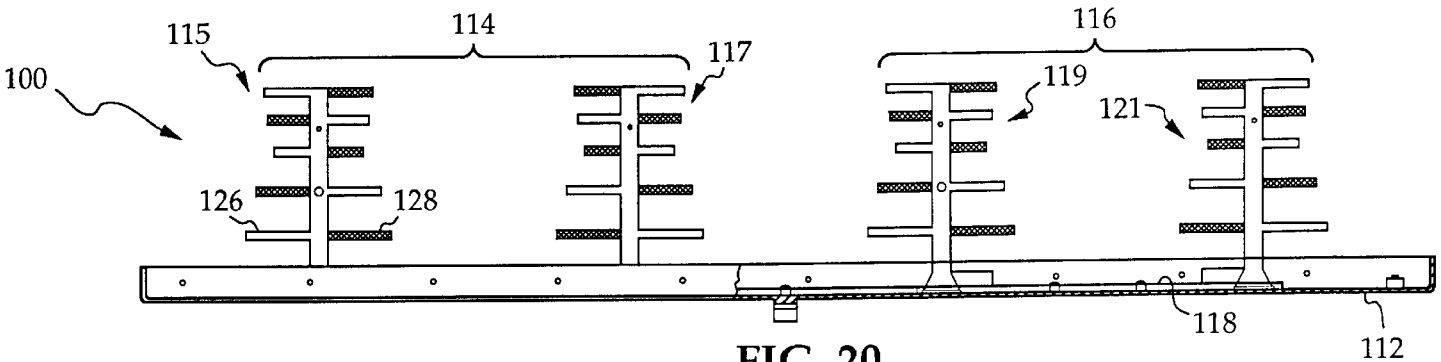
FIG. 20 is a side partial cutaway view of a log periodic dipole antenna having hourglass dipoles that is also the subject matter of the present application.

In FIG. 20, the log periodic dipole antenna 100 includes a reflector 112, an upper hourglass dipole assembly 114, a lower hourglass dipole assembly 116 and a microstrip feedline 118.

The reflector 112 is typically mounted vertically to an antenna tower (not illustrated) and supports the various components described above while shaping and directing the radiation pattern of the antenna 100.

The upper hourglass dipole assembly 114 includes an hourglass dipole generally indicated as 115 having an hourglass dipole strip 126 (unshaded as shown) and a corresponding hourglass dipole strip 128 (shaded as shown).

In the hourglass dipole 115, the hourglass dipole strips 126, 128 are flat like the dipole strip shown in FIGS. 1–8, mounted perpendicular to the reflector 112 and adjacent and parallel to each other, and connected to the microstrip line 118 similar to the dipole strips shown in FIGS. 1–8.

The upper hourglass dipole assembly 114 includes another hourglass dipole generally indicated as 117, and the lower hourglass dipole assembly 116 includes two hourglass dipoles generally indicated as 119, 121. The two hourglass dipoles 117, 119, 121 are functionally and structurally similar to the hourglass dipole 115. For example, in FIG. 22 the hourglass dipole 121 has a dipole strip connector 146 for connecting the hourglass dipole 121 to a centerfeed conductor assembly generally indicated as 148 of the microstrip transmission line 118, similar to that shown in FIGS. 1–8. The hourglass dipole 121 also has a non-conducting spacer for connecting the dipole strips, similar to that shown in FIGS. 1–8.

Figure 23:
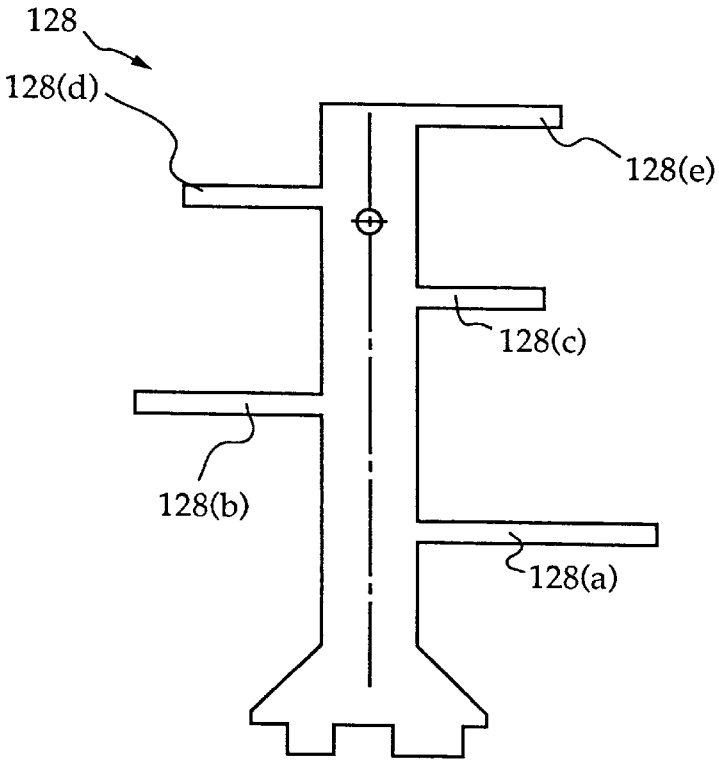
FIG. 23 is a plan view of an hourglass dipole strip that is the subject matter of the present application.

FIG. 23 shows the hourglass dipole strip 128 having five radiating elements 128(*a*), 128(*b*), 128(*c*), 128(*d*) and 128(*e*) similar to the dipole strip 20 shown and described in FIG. 1 above. However, as shown in FIG. 23 the hourglass dipole strip 128 has a shortest radiating element 128(*c*) that is arranged in the middle of the dipole strip, not at the top like the dipole strip shown and described in FIGS. 1–8.

In the present invention, the hourglass dipole assembly maintains the same number of radiating elements as the antenna shown in FIGS. 1–8, and thus has the same front-to-back ratio. However, due to the non-progressive nature of the arms, the beam is not narrowed. The impedance of the hourglass dipole is about the same as the antenna shown in FIGS. 1–8, because the lengths of radiating elements that were changed are above the feedpoint.

The antenna of the present invention can be used wherever a customer desires a high front-to-back ratio with a ninety degree beamwidth at PCS frequencies. Also at cellular frequencies, one hundred degree beamwidths with a high front-to-back ratio are possible since cellular antennas do not suffer from radome shrinkage the way PCS logs do. This is compared to the ninety degree beamwidths of a normal log periodic dipole. A normal one hundred degree antenna must use quarter wave dipoles and only has a front-to-back ratio of twenty dB.

Figure 24:
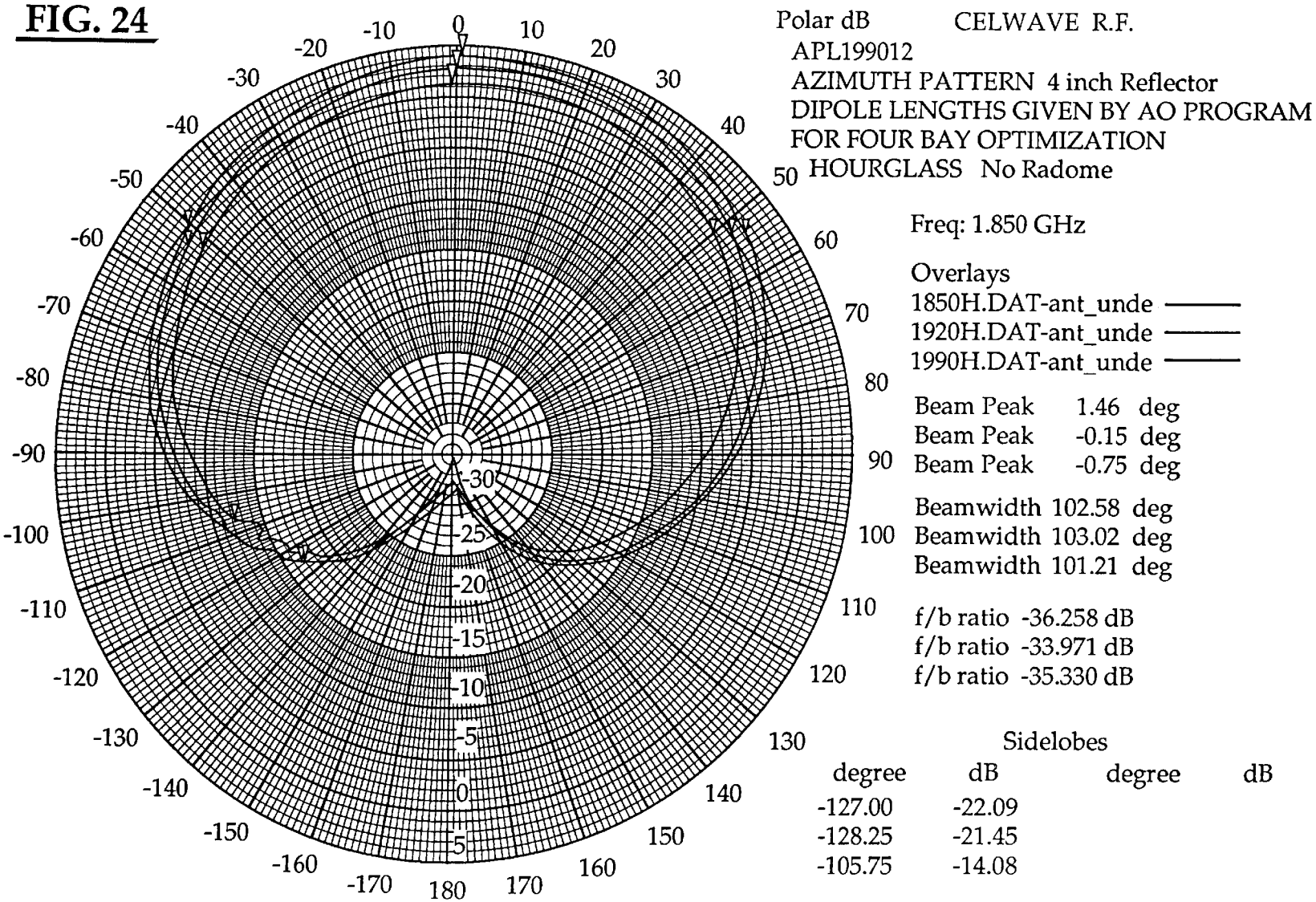
FIG. 24 is a pattern for a log periodic dipole antenna using the hourglass dipole shown in FIGS. 20–23 with a four inch reflector and with no radome at an operational frequency of 1.850, 1.920 and 1.990 Gigahertz.
Figure 25:
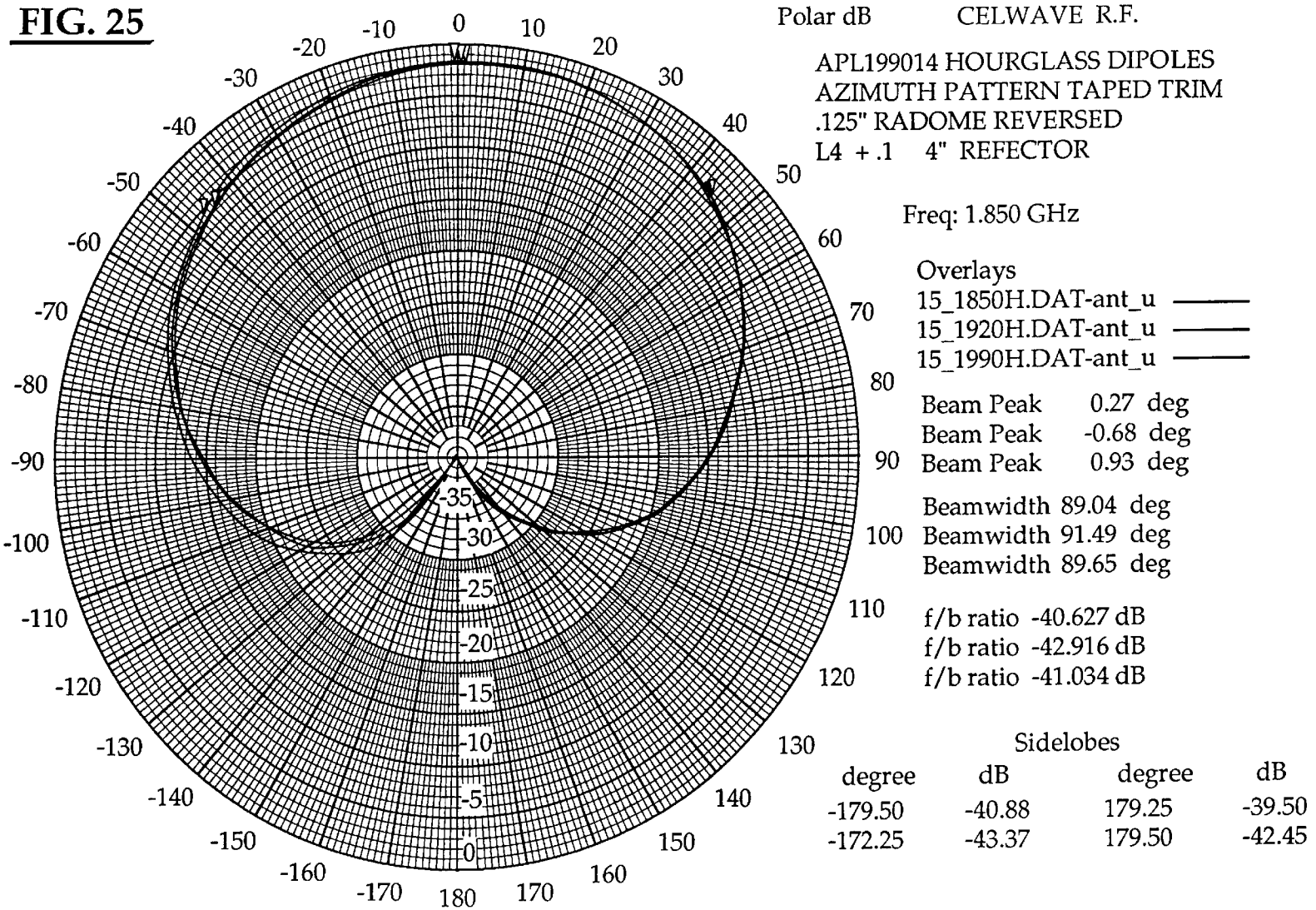
FIG. 25 is a pattern for a log periodic dipole antenna shown in FIGS. 20–23 with a four inch reflector and with a radome at an operational frequency of 1.850, 1.920 and 1.990 Gigahertz.
Figure 27:
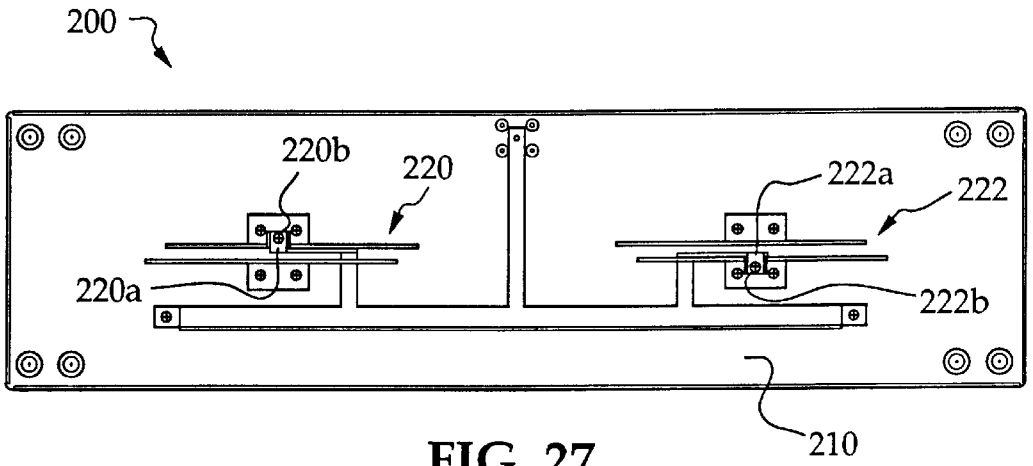
FIG. 27 shows a plan view of the antenna shown in FIG. 12

FIGS. 24 and 25 show the respective beamwidths. The hourglass dipole overcomes the shortcomings discussed above by having a starting beamwidth of one hundred degrees, while maintaining a high front-to-back ratio. When a radome is placed on, it shrinks to the desired ninety degree beamwidth.

The hourglass dipoles are not limited to center fed systems shown in FIGS. 1–8. The beamwidth will increase, while maintaining the high front-to-back ratio on a top fed dipole using cables, just as much as it does on the center fed antenna using a microstrip. The thrust of the invention relates to the shape of the dipole arms. The scope of the invention is not intended to be limited to any particular feed system. As a person skilled in the art would appreciate, any feed system can be used in combination with the hourglass dipoles.

Figure 21:
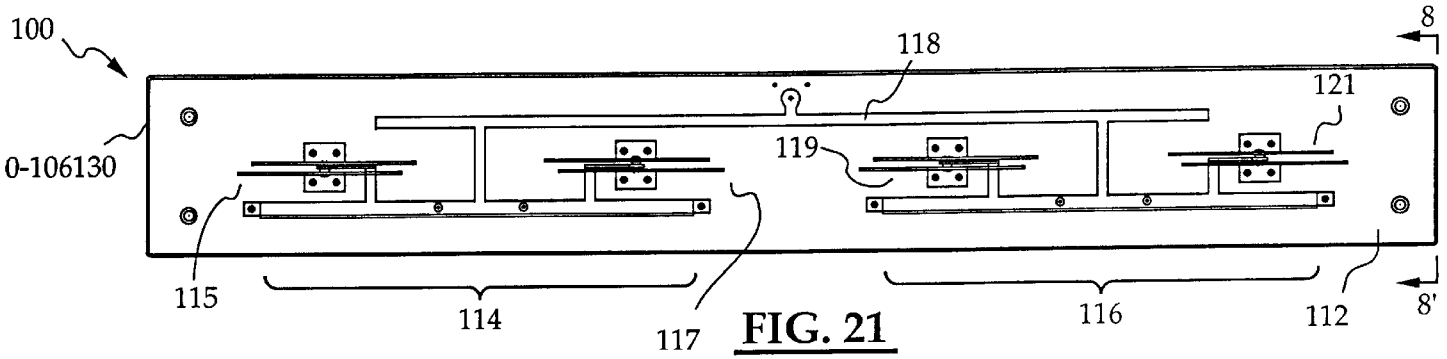
FIG. 21 is an elevational view of the log periodic dipole antenna having hourglass dipoles shown in FIG. 20.
Figure 22:
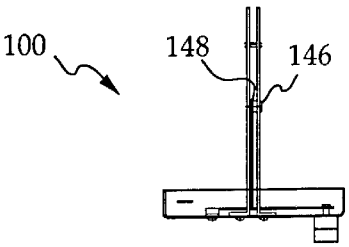
FIG. 22 is a side view of the log periodic dipole antenna having hourglass dipoles shown in FIG. 21 along lines 8–8'.
Figure 26:
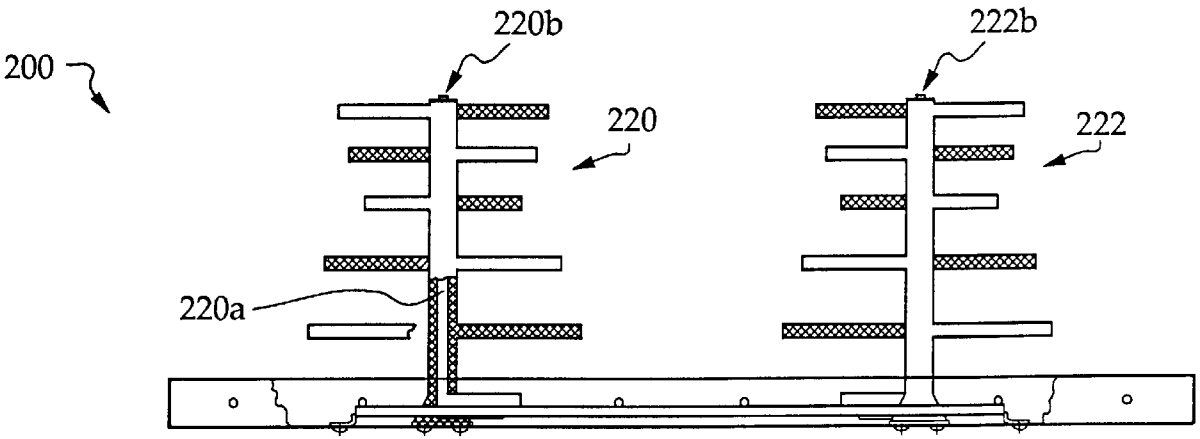
FIG. 26 shows a side partial cutaway view of another embodiment of the present invention having hourglass dipoles and a top fed microstrip transmission system.

FIG. 26 shows a log periodic antenna generally indicated as 200 having a top fed microstrip transmission system generally indicated as 210 in place of the microstrip feed system 118 shown for example in FIG. 21. As shown, the log periodic antenna has two hourglass dipoles generally indicated as 220, 222 that are coupled to the top fed microstrip transmission system by a connector generally indicated as 220*a*, 222*a* and a fastener generally indicated as 220*b*, 222*b* in a manner that is known in the art.

The log periodic dipole antenna of the present invention is illustrated as having two hourglass dipole assemblies 114, 116. As would be appreciated by a person skilled in the art, any number of dipole assemblies, including only one, could be provided without departing from the scope of the present invention. In addition, as would be appreciated by a person skilled in the art, the dimensions of the various components of the present invention are shown in inches, and may be sized differently depending upon the specific application. Most importantly, a person skilled in the art would readily recognize how the unique arrangement of the log periodic hourglass dipole antenna of the present invention overcomes the disadvantages of an antenna typically used for personal communication systems frequencies.

Although the present invention has been described and discussed herein with respect to at least one embodiment, other arrangements or configurations may also be used that do not depart from the spirit and scope hereof.

We claim:

1. A log periodic dipole antenna (10), comprising:

(a) at least one log periodic dipole assembly (14, 16) having two dipole strips (26, 28, 30, 32) with a dipole strip connector (46) therebetween; and (b) a microstrip feedline (18) having a centerfeed conductor (18C) arranged between the two dipole strips (26, 28, 30, 32) and coupled to said dipole strip connector (46).

2. The log periodic antenna (10) according to claim 1, wherein said centerfeed conductor (18C) is arranged between said two dipole strips (26, 28, 30, 32).

3. The log periodic antenna (10) according to claim 1, wherein said dipole strip connector (46) electrically connects one of said two dipole strips (26, 28, 30, 32) to said centerfeed conductor (46).

4. The log periodic antenna (10) according to claim 1, wherein each of said two dipole strips (26, 28, 30, 32) includes a plurality of alternating radiating elements (34).

5. The log periodic antenna (10) according to claim 4, wherein each log periodic dipole assembly (14, 16) includes a plurality of dipoles, each dipole being formed by a pair of adjacent alternating radiating elements (34) on said two dipole strips (26, 28, 30, 32).

6. The log periodic antenna (10) according to claim 5, wherein said plurality of dipoles includes five dipoles, and said dipole strip connector (46) is arranged at a midpoint of said two dipole strips (26, 28, 30, 32) near a fourth dipole.

7. The log periodic antenna (10) according to claim 1, wherein said log periodic antenna (10) further comprises a reflector (12), and wherein said microstrip feedline (18) has at least one microstrip mounting portion (18A) arranged on said reflector (12).

8. The log periodic antenna (10) according to claim 7, wherein each of said two dipole strips (26, 28, 30, 32) includes an L-shaped base (30B, 32B) arranged on said reflector (12).

9. The log periodic antenna (10) according to claim 5, wherein said plurality of dipoles includes five dipoles, wherein said two dipole strips (26, 28, 30, 32) include a nonconducting spacer (38) for providing electrically insulated structural support for each dipole assembly (14, 16), said nonconducting spacer (38) being arranged adjacent to a second and third dipole.

10. The log periodic antenna (10) according to claim 7, wherein said microstrip feedline (18) includes an input feed portion (18B) arranged on said reflector (12) and connected to an input connector (40) for receiving an input radio signal.

11. The log periodic antenna (10) according to claim 1, wherein said log periodic antenna (10) further comprises a second log periodic dipole assembly (14, 16) having two dipole strips (26, 28, 30, 32) with a second dipole strip connector (46) therebetween, and wherein said microstrip feedline (18) includes a second centerfeed conductor (18B) coupled to said second dipole strip connector (46).

12. The log periodic antenna (10) according to claim 11, wherein said second centerfeed conductor (46) is arranged between said two dipole strips (26, 28, 30, 32) of said second log periodic dipole assembly (14, 16).

13. A center fed log periodic dipole antenna (10) comprising:

A) a reflector (12) for shaping the radiating pattern of said center fed log periodic dipole antenna (10);

B) at least one dipole assembly (14) attached to said reflector (12), said at least one dipole assembly (14) including, i) a first dipole strip (26) having a front end and an "L" shaped base (26B), said "L" shaped base (26B) of said first dipole strip (26) being attached to said reflector (12), ii) a plurality of first radiating elements (34) of varying lengths integrally formed with and appending from said first dipole strip (26), iii) a second dipole strip (28) disposed adjacent to and parallel with said first dipole strip (26), said second dipole strip (28) having a front end and an "L" shaped base (28B), said "L" shaped base (28B) of said second dipole strip (28) being attached to said reflector (12), and iv) a plurality of second radiating elements (34) of varying lengths integrally formed with and appending from said second dipole strip (28), said pluralities of first and second radiating elements (34) being arranged to form a plurality of dipoles having a 180 degree phase shift between successive radiating elements; and C) a microstrip feedline (18) attached to said reflector (12) and including at least one centerfeed conductor (18C), each of said at least one centerfeed conductors (18C) corresponding to each of said at least one dipole assemblies (14, 16), each of said at least one centerfeed conductors (18C) further being disposed between said first and second dipole strips (26, 28) of its corresponding dipole assembly (14, 16) and electrically connected to one of said dipole strips (26, 28) at a point between said front end and said "L" shaped base (26B, 28B) of said dipole strip (26, 28).

14. The center fed log periodic dipole antenna (10) of claim 13, wherein the number of said plurality of first radiating elements (34) is five (5), the first and shortest of said first plurality of radiating elements (34) being disposed near said front end of said first dipole strip (26), the fifth and longest of said first plurality of radiating elements (34) being disposed near said "L" shaped base (26B) of said first dipole strip (26), the remaining of said plurality of first radiating elements (34) being arranged in order by increasing lengths between said first and fifth of said plurality of first radiating elements (34), and wherein the number of said plurality of second radiating elements (34) is five (5), the first and shortest of said second radiating elements (34) being disposed near said front end of said second dipole strip (28), the fifth and longest of said second plurality of radiating elements (34) being disposed near said "L" shaped base (28B) of said second dipole strip (28), the remaining of said plurality of second radiating elements (34) being arranged in order by increasing lengths between said first and fifth of said plurality of second radiating elements (34).

15. The center fed log periodic dipole antenna (10) of claim 14, wherein each of said at least one centerfeed conductors (46) is electrically connected to one of said dipole strips (26, 28, 30, 32) at a fourth radiating element (34).

16. A log periodic dipole antenna (100, 200), comprising:

(a) a microstrip feedline (118) having a centerfeed conductor (148, 220*a*, 222*a*); and (b) at least one log periodic hourglass dipole assembly (114, 116, 220, 222) having two hourglass dipole strips (20, 126, 128) with a dipole strip connector (146, 220*b*, 222*b*), the microstrip feedline (118) being arranged between the two hourglass dipole strips (20, 126, 128), the dipole strip connector (146, 220*b*, 222*b*) being coupled to the centerfeed conductor (148, 220*a*, 222*a*) of the microstrip feedline (118).

17. The log periodic antenna (100, 200) according to claim 16, wherein the centerfeed conductor (148, 220*a*, 222*a*) is arranged between the two hourglass dipole strips (20, 126, 128).

18. The log periodic antenna (100, 200) according to claim 16, wherein the dipole strip connector (146, 220*b*, 222*b*) electrically connects one of the two hourglass dipole strips (20, 126, 128) to the centerfeed conductor (148, 220*a*, 222*a*).

19. The log periodic antenna (100, 200) according to claim 16, wherein each of the two hourglass dipole strips (20, 126, 128) includes a plurality of alternating radiating elements (128(*a*), 128(*b*), 128(*c*), 128(*d*), 128(*e*)).

20. The log periodic antenna (100, 200) according to claim 19, wherein each log periodic hourglass dipole assembly (114, 116, 220, 222) includes a plurality of hourglass dipoles (115, 117, 119, 121), each being formed by a pair of adjacent alternating radiating elements (128(*a*), 128(*b*), 128(*c*), 128(*d*), 128(*e*)) on said two hourglass dipole strips (20, 126, 128), and a shortest one of the plurality of radiating elements (128(*a*), 128(*b*), 128(*c*), 128(*d*), 128(*e*)) is arranged in the middle of the hourglass dipole assembly (114, 116, 220, 222).

21. The log periodic antenna (100, 200) according to claim 20, wherein said plurality of hourglass dipoles (115, 117, 119, 121) includes five radiating elements (128(*a*), 128(*b*), 128(*c*), 128(*d*), 128(*e*)), and said dipole strip connector (146, 220*b*, 222*b*) is arranged at a midpoint of said two hourglass dipole strips (20, 126, 128) near a fourth arm (128(*d*)).

22. The log periodic antenna (100, 200) according to claim 16, wherein the log periodic antenna (100, 200) further comprises a reflector (112); and wherein the microstrip feedline (118) has at least one microstrip mounting portion (unlabelled) arranged on said reflector (112).

23. The log periodic antenna (100, 200) according to claim 22, wherein the microstrip feedline (118) includes an input feed portion (unlabelled) arranged on the reflector (112) and connected to an input connector (unlabelled) for receiving the input radio signal.

24. The log periodic antenna (100, 200) according to claim 16, wherein the microstrip feedline (118) includes a second centerfeed conductor (222*a*); and wherein the log periodic antenna (100, 200) further comprises a second log periodic hourglass dipole assembly (114, 116, 220, 222) having two hourglass dipole strips (20, 126, 128) with a second hourglass dipole strip connector (146, 220*b*, 222*b*) coupled to the second centerfeed conductor (148, 220*a*, 222*a*).

25. The log periodic antenna (100, 200) according to claim 24, wherein the second centerfeed conductor (222*a*) is arranged between the two hourglass dipole strips (20, 126, 128) of the second log periodic hourglass dipole assembly (114, 116, 220, 222).

26. A log periodic dipole antenna (100, 200) comprising:

(a) microstrip center feedline means (118), responsive to an input radio signal for providing a microstrip center feed radio signal;

(b) a log periodic hourglass dipole assembly (114, 116, 220, 222), responsive to the microstrip feed radio signal for providing a log periodic hourglass dipole antenna radio signal; and the microstrip center feedline (118) being arranged between the log periodic hourglass dipole assembly (114, 116, 220, 222).

27. The log periodic antenna (100, 200) according to claim 26, wherein the log periodic hourglass dipole assembly (114, 116, 220, 222) includes a plurality of hourglass dipoles (115, 117, 119, 121), each being formed by a pair of adjacent alternating radiating elements (128(*a*), 128(*b*), 128(*c*), 128(*d*), 128(*e*)) on two hourglass dipole strips (20, 126, 128), and a shortest one (128(*c*)), of the plurality of radiating elements (128(*a*), 128(*b*), 128(*c*), 128(*d*), 128(*e*)) is arranged in the middle of the hourglass dipole assembly (114, 116, 220, 222).

28. The log periodic antenna (100, 200) according to claim 26, wherein the input signal is a radio signal having a Personal Communication Systems (PCS) frequency.

29. The log periodic antenna (100, 200) according to claim 28, wherein the Personal Communication Systems (PCS) frequency is in a frequency range of 1.850–1.990 Gigahertz.

30. The log periodic antenna (100, 200) according to claim 26, wherein the microstrip center feed means (118) is a top fed microstrip transmission system.

31. The log periodic antenna (100, 200) according to claim 30, wherein the log periodic hourglass dipole assembly (114, 116, 220, 222) is coupled to the top fed microstrip transmission system by a connector (146, 220*b*, 222*b*) and a fastener (220*b*, 222*b*).

* * * * *